United States Patent [19]

Walsh

[11] 4,074,963

[45] Feb. 21, 1978

[54] KILN

[75] Inventor: William J. Walsh, Dubuque, Iowa

[73] Assignee: Sybron Corporation, Rochester, N.Y.

[21] Appl. No.: 714,380

[22] Filed: Aug. 16, 1976

[51] Int. Cl.[2] ..... F27D 1/18

[52] U.S. Cl. ..... 432/250; 110/173 R; 266/253

[58] Field of Search ..... 432/250; 110/173 R, 110/176, 177; 266/253

[56] References Cited

U.S. PATENT DOCUMENTS

| | | | |
|---|---|---|---|
| 1,015,696 | 1/1912 | Lucia | 110/173 R |
| 1,391,690 | 9/1921 | Pilliod | 110/176 |
| 1,773,049 | 8/1930 | Lobley | 110/173 R |
| 2,039,761 | 5/1936 | Weniger | 110/176 X |
| 2,323,828 | 7/1943 | Mayer | 110/176 |
| 2,483,968 | 10/1949 | Ecklund | 110/176 |
| 3,484,085 | 12/1969 | Montagino | 266/253 |

*Primary Examiner*—John J. Camby

*Attorney, Agent, or Firm*—Theodore B. Roessel; Roger Aceto

[57] ABSTRACT

A kiln has a bottom opening for loading the objects to be fired into the firing chamber. The door for closing the firing chamber provides the hearth of the kiln and supports the objects to be fired. A parallel linkage mechanism maintains the door in a horizontal orientation as it is moved from the closed position wherein the objects to be fired are in the kiln, to the open position wherein the objects are supported in front of the kiln.

3 Claims, 3 Drawing Figures

KILN

BACKGROUND OF THE DISCLOSURE

The present invention relates generally to kilns, furnaces and the like and more particularly to a bottom loading kiln and the door arrangement for closing such opening. A typical kiln or furnace having a front load opening is shown in U.S. Pat. No. 2,483,968. This patent shows the kiln door operated by a parallel motion linkage which keeps the door vertically oriented as it is swung between an open and closed position.

The present invention is an improvement over this general construction wherein the opening for loading the article to be fired is moved from the front of the furnace to the bottom. With this arrangement the door itself becomes a movable hearth on which the articles to be fired are supported both in and out of the furnace. The advantages of such construction are threefold. First, the articles to be fired are brought to a point where they are easily accessible for loading and unloading the furnace, or for observing intermediate results during the actual firing. Secondly, heat leakage due to convection past the door seal is minimized and third, any load may be pre-heated by only partly closing the door-hearth plate, so that the goods are only partly supported in the firing chamber.

DESCRIPTION OF THE PREFERRED EMBODIMENTS

Figure 1:
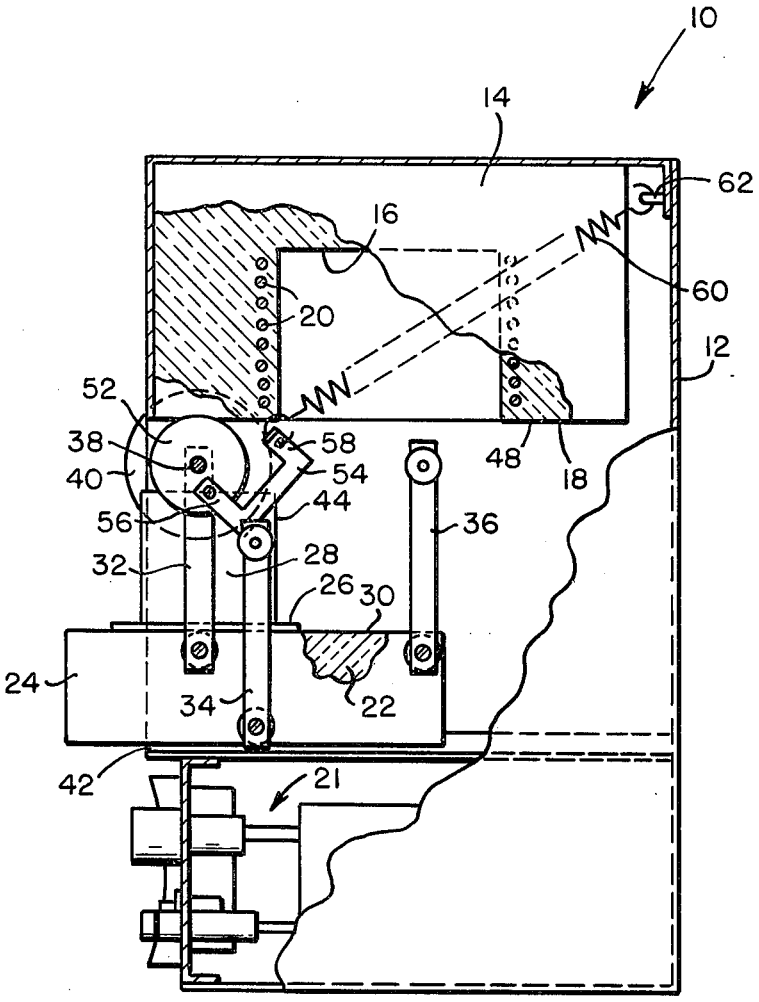
FIG. 1 is a side elevation view partly broken away and in section showing the kiln of the present invention with the door half open.

Referring to the drawings, FIG. 1 shows the kiln or furnace of the present invention generally indicated at 10. The kiln includes an upright outer frame or housing 12. Disposed within the upper portion of the housing is an insulated oven portion 14. The oven encloses a firing chamber 16 which opens through the bottom 18 of the oven portion. The oven can be made of any suitable material such as fire brick or any of the filter molded heat insulating materials as is well known in the art and can be heated by any suitable means such as the electric resistant heating coils indicated at 20. These coils are connected by means well known in the art to a transformer and oven controls indicated at 21 located in the bottom portion of the furnace.

The opening of the firing chamber is closed by a door member which includes a body 22 made of a suitable heating insulating material disposed in a metal pan 24. The upper surface of the door body is provided with a raised portion 26, adapted to extend slightly into the firing chamber. This portion provides the hearth plate on which the article to be fired, indicated at 28, is placed. The surface 30 of the door body surrounding this raised portion engages against the bottom 18 of the oven portion to provide an appropriate heat seal.

Figure 2:
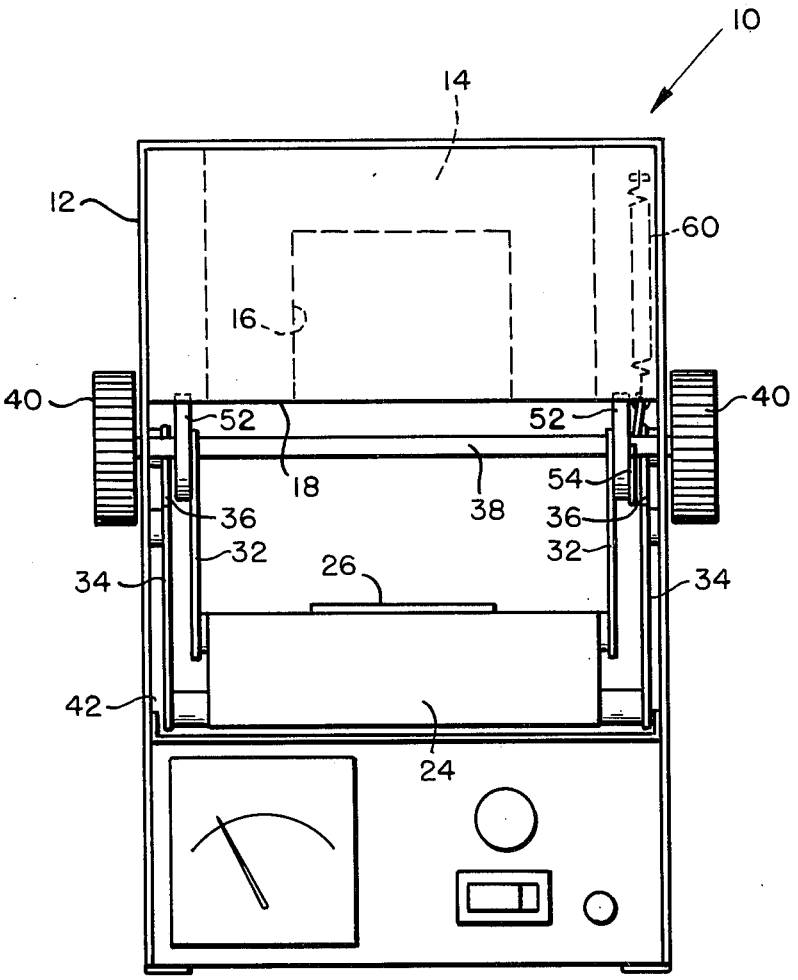
FIG. 2 is a front elevation view of the kiln as shown in FIG. 1.

The means for opening and closing the door to the furnace as will be discussed hereinbelow, is connected between the door pan 24 and the frame 12 of the furnace. As shown in FIG. 1 the means for opening the door of the furnace includes a parallel motion linkage defined by three links, 32, 34 and 36. It should be understood that there is a corresponding set of links on the other side of the door (FIG. 2) which operates as the set described herein below. Each of the links is pivioted at one end to pan 24 and at the other end to frame 12. The end of link 32 pivoted to the frame is mounted on a drive shaft 38. This drive shaft can be operated by any suitable drive means indicated at 40 (FIG. 2) such as a hand wheel, lever arm or motor for rotating the shaft.

Figure 3:
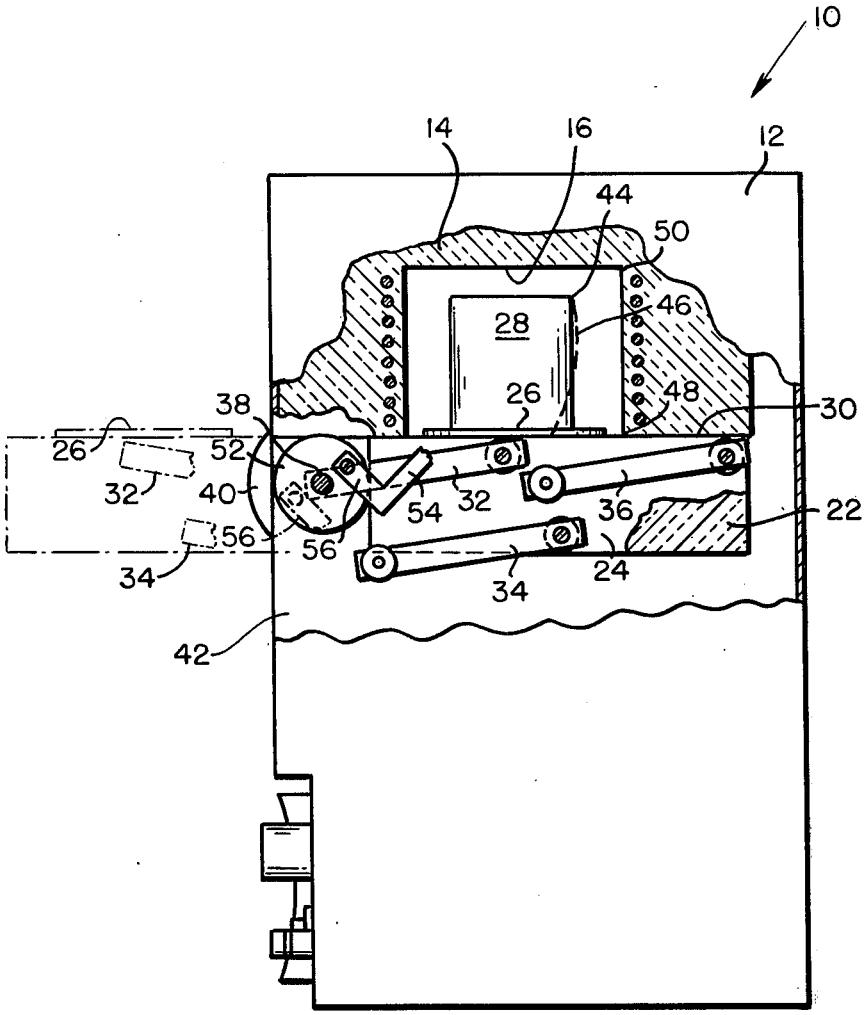
FIG. 3 is a side elevation view similar to FIG. 1 showing the kiln in a closed position with the phantom line showing the kiln in the open position.

As shaft 38 rotates, links 32, 34 and 36 are pivoted downwardly from the door closed position shown in solid line in FIG. 3 and through an opening 42 in the front of frame 12. This presents the oven door in a position outside of the oven as shown in phantom line in FIG. 3. In moving from the solid line to the phantom line position, the parallel motion linkage maintains the door and therefore hearth 26 in a horizontal orientation. With the door in position in front of the kiln, articles can be placed on or removed from the hearth plate 26. Drive shaft 38 is then rotated in the opposite direction to return the door to the closed position as shown in solid line wherein the articles to be fired or heat treated are supported within firing chamber 16.

The function of the parallel motion linkage could be accomplished by utilizing any two of the links 32, 34 or 36. However, when only two links are used, there can be problems in maintaining the door in a stable horizontally oriented position as the two links move into an axially aligned position during the travel of the door between an open and a closed position. While this problem can be minimized by closely controlling the tolerances at the pivot points to reduce play as much as possible, it is believed that a more convenient solution to the problem is simply to provide an extra link. With this arrangement, whenever two of the links are in an axially aligned position, a third link will still be offset from the axis of the first two, providing the required measure of stability to maintain the door in a horizontal position.

From FIG. 3, it should be apparent that as the door is moved from a closed to an open position, the upper rear edge 44 of load 28 moves through an acurate path of travel, a portion of which is indicated by the dotted line 46. Some care must be taken to locate the load so as to prevent it from bumping against the rear of the chamber and particular against the bottom rear edge 48 of the firing chamber as the load is either removed or introduced into the chamber. To prevent this, and simultaneously in order to make the horizontal dimension of chamber 16 as small as possible, it is preferred that the vertical distance between the pivot points of each of the links be one-half the height of the maximum load to be placed within the firing chamber. With this arrangement, links 32, 34 and 36 will be in a horizontal orientation when the tallest possible load is halfway into the firing chamber. Also, the top of the tallest load in moving through the path indicated by dotted line 46 wll be at a maximum distance from the firing chamber bottom rear edge 48 when just passing through the plane of the oven bottom 18. Likewise, when the load is completely inserted into the firing chamber, the top of the load will be at a maximum distance from the upper rear edge 50 of the firing chamber. Consequently, the point of minimum clearance between the load and the rear of the firing chamber as illustrated by dotted line 46 occurs when the tallest load is half way into the firing chamber.

It should also be appreciated that even with this arrangement, care must be taken to correctly locate the load on the door. Otherwise, the load could bump against the bottom of the oven portion. Accordingly, there are several ways of defining the hearth plate or useable area of the door. For example, the hearth plate portion 26 may be raised as shown in the figures and the articles to be fired or heat treated only on the raised portion. The useable area also can be defined by a line scribed on the door surface or by a colored area or other suitable means (not shown).

Since the kiln of the present invention is bottom loaded, a counterbalance is needed in embodiments where the door is manually operated to prevent the door from opening under the influence of gravity during the firing or heat treating operation. To this end, one or both ends of shaft 38 is provided with a disc 52. A generally C-shaped member 54 has one leg 56 pivoted to the disc and its other leg 58 connected to one end of a coil spring 60. The other end of the coil spring is fixed adjacent the upper rear of frame 12 as indicated at 62 in FIG. 1. Spring 60 in this way can apply sufficient force to the disc and shaft to keep the door in a closed position during firing.

As the door is opened, the C-shaped member moves from the solid line position to the dotted line position as shown in FIG. 3. The member is thus able to straddle shaft 38 to prevent the spring from stretching over against the shaft.

It is preferred that the spring initially be stretched a distance several times the differential stretch represented by the limits of door movement so that the force presented by the spring is essentially constant regardless of the door position.

Thus, it should be appreciated that the present invention provides a novel kiln having several advantages. For example, during firing the door can be partly opened to view the stage of firing without any excessive loss of heat by convection as would occur if the kiln had a conventional door at its front. Further, articles can be heated slowly or preheated before actual firing by holding the door partly open which locates articles at some distance from the source of heat. Another advantage is that articles once fired or heat treated can be removed and held in the atmosphere for cooling or for visual examination without the need to reach into the firing chamber to grasp and pick up the article with tongs or the like.

Having thus described the invention in detail, what is claimed as new is:

1. A kiln, furnace or the like comprising:

a. a frame;

b. an oven body in said frame, said oven body enclosing a firing chamber which opens through the bottom of said body;

c. a door for closing said opening including a hearth plate portion for supporting articles to be heated in said firing chamber when said door is in a closed position;

d. at least two parallel links on each side of said door, each link having a first end pivoted to said frame and a second end pivoted to said door to form a parallel motion linkage for maintaining said door horizontally oriented as said door moves from a closed position to an open position; and e. said first end of each link being located below said second end by a distance of about one-half the vertical height of said chamber when said door is in a closed position.

2. A kiln as in claim 1 including a third link oriented in a plane disposed below and parallel to the planes of said two links.

3. A kiln, furnace, or the like comprising:

a. a frame;

b. an oven body in said frame, said oven body enclosing a firing chamber which opens through the bottom of said body;

c. a door for closing said opening, said door having a hearth plate portion for supporting articles to be heated in said firing chamber and a sealing surface surrounding said hearth plate portion for sealing against the bottom of said oven body about said chamber opening;

d. parallel motion linkage means between said frame and door for swinging said door between an open and closed position, said means maintaining said door in a horizontal orientation as the door is swung from a closed position, wherein the articles are supported in said firing chamber and said chamber opening is sealed, to an open position wherein the articles are supported in front of said oven body;

e. a shaft connecting one end of said linkage means to said frame;

f. a disc on said shaft;

g. a C-shaped member having one leg pivoted to said disc; and h. a spring extending between and connected to said frame and a second leg of said C-shaped member for exerting a door closing bias on said shaft.

* * * * *